United States Patent [19]

Wildman et al.

[11] 4,289,147

[45] Sep. 15, 1981

[54] PROCESS FOR OBTAINING DEPROTEINIZED TOBACCO FREED OF NICOTINE AND GREEN PIGMENT, FOR USE AS A SMOKING PRODUCT

[75] Inventors: Samuel G. Wildman, Santa Monica, Calif.; Shuh J. Sheen, Lexington, Ky.

[73] Assignee: Leaf Proteins, Inc., Carson, Calif.

[21] Appl. No.: 94,584

[22] Filed: Nov. 15, 1979

[51] Int. Cl.[3] ..... A24B 15/20; A24B 15/24; A24B 15/30; A24B 3/14

[52] U.S. Cl. ..... 131/290; 131/311

[58] Field of Search ..... 131/140 R, 142 A, 141, 131/140 C, 140 B, 143

[56] References Cited

U.S. PATENT DOCUMENTS 3,145,717 8/1964 Osborne et al. ..... 131/143

4,083,371 4/1978 Beringer et al. ..... 131/140 C

*Primary Examiner*—V. Millin

*Attorney, Agent, or Firm*—Lyon & Lyon

[57] ABSTRACT

Described herein is a process for obtaining a smoking product from tobacco leaves. The leaves, or leaves and stalk together when immature plants are used in the process, are ground or otherwise pulverized to liberate the liquid portion of the leaves from the plant material. The liquid portion of the leaves is treated to remove water-soluble proteins and nicotine and the solid portion of the leaves is treated to remove water and insoluble protein material, nicotine and green pigment material. The residues obtained after separation of the water-soluble and -insoluble protein, nicotine and green pigment material are recombined to yield a processed tobacco which is suitable for use in cigarettes as a tobacco filler or other products of tobacco manufacture.

30 Claims, No Drawings

PROCESS FOR OBTAINING DEPROTEINIZED TOBACCO FREED OF NICOTINE AND GREEN PIGMENT, FOR USE AS A SMOKING PRODUCT

FIELD OF THE INVENTION

In a broad aspect, this invention relates to a process for obtaining a smoking product from tobacco plants. In another and more specific aspect, it relates to a process for removing protein, nicotine and green pigment materials from tobacco which is to be used in cigarettes or other products of tobacco manufacture.

CROSS-REFERENCE TO RELATED APPLICATIONS

This application is related to and incorporates by reference, as though fully set forth herein, the disclosure of the co-pending and commonly assigned application of S. G. Wildman and P. Kwanyuen, entitled "Process for Isolation of Proteins From Plant Leaves," filed Sept. 24, 1979, having Ser. No. 78,505.

BACKGROUND

Cigarettes and other products of tobacco manufacture are, for the most part, blends of two principal types of tobacco, so-called "flue-cured" and "burley" tobaccos. American cigarettes, for example, are generally comprised of two-thirds flue-cured tobacco and one-third burley tobacco.

For the most part, the cultivation of flue-cured and burley tobaccos occurs in the states of North Carolina, Virginia, Kentucky, Tennessee, South Carolina and Georgia. Production of flue-cured tobacco is largely in a region adjacent to the Atlantic Coast whereas burley tobacco is grown in more inland and upland regions. The growing and harvesting of flue-cured tobacco and burley tobacco differ in a number of respects.

In the case of flue-cured tobacco, the lowermost leaves are detached from the plant stalk as they mature and begin to yellow. The detached leaves are suspended in bunches on sticks which are hung in barns and the tobacco "flue-cured," i.e., dried by air heated by heat exchange with hot air passing through flues.

Burley tobacco, on the other hand, is allowed to mature until nearly all of the leaves on the stalks have yellowed. Then the entire plant is cut off near the ground and the stalk and leaves allowed to wilt in the field over a period of several days. The entire plant is then hung in specially designed barns where it is allowed to air-dry in a slow curing process.

The cultivation of tobacco, particularly flue-cured tobacco, is a labor-intensive process. Therefore, there has been the inevitable trend towards mechanization of this process. To that end, the United States Department of Agriculture has developed a process known as the "homogenized leaf-curing process," which is less expensive than the conventional curing processes.

In this process, the yellowed leaves of tobacco plants grown in the conventional manner are harvested and pulped. Water is added to the pulp which is then agitated at a temperature of about 25° C. for about 24 hours. During this time, the proteolytic enzymes already in the leaves digest some of the proteins that remain in the leaves at the time they are harvested. After the digestion, the excess water is squeezed out of the now dark-brown pulp, which is then dried and serves as a starting material for a reconstituted tobacco product used as a tobacco filler in cigarette manufacture much like the low-quality tobacco obtained as a product of conventional curing processes.

The resulting product is somewhat safer for smoking than tobacco obtained from conventional curing processes since it has a diminished protein concentration, proteins being one source of the undesirable products in cigarette smoke.

As in conventional cultivation, it is of the utmost importance that the tobacco leaves be allowed to turn yellow in the natural way before they are harvested for use in the homogenized leaf-curing process. Nevertheless, the homogenized curing process is not capable of removing sufficient green pigment material from the leaves to the extent that the product has been acceptable to the tobacco industry.

In the course of the slow-burning characteristic of tobacco products such as cigarettes, pipe tobacco and cigars, nicotine, "tars," and other products considered to have adverse effects on the smoker's health are liberated in the smoke which is drawn into the smoker's mouth and lungs. In view of health considerations, cigarette manufacturers have devised systems to reduce the nicotine and tar content of the burning tobacco. However, the biggest part of this reduction has not been achieved by developing new kinds of tobacco low in tar and nicotine. Instead, it has been achieved by changing the manner in which the cigarette is constructed.

Thus, filters that reduce some of the tar content have become widely used. However, most of the reduction has come from so-called "bypass" systems which utilize porous paper in the manufacture of cigarettes which permit air to be drawn through pores in the paper to dilute the gases generated by burning tobacco.

Although these techniques have resulted in a safer smoking product, they do not remove all of the undesirable constituents in the tobacco smoke. Furthermore, these processes result in a reduction in the flavor components of the smoke and this reduction in taste has been criticized by smokers. Accordingly, there exists a need for the development of a tobacco product which is inherently low in nicotine and tars but that retains important flavor ingredients.

Accordingly, an object of the present invention is a tobacco product suitable for use in cigarettes and other tobacco manufactures which has a reduced protein, nicotine and tar content but which retains desirable flavor constituents.

Another object of this invention is to make available a process for obtaining a tobacco product suitable for use in cigarettes and other smoking products which is less labor-intensive than conventional processes.

That these and other objects may be accomplished by the present invention will be apparent to those skilled in the art from the following summary and detailed description of the invention.

SUMMARY OF THE INVENTION

The present invention provides a process for treating tobacco, even immature tobacco, to obtain a deproteinized tobacco material suited for use in cigarettes and other tobacco products having a reduced tar content and from which nicotine and green pigments have been removed. The process comprises converting tobacco to a pulp comprising a liquid portion and a solids portion, the latter comprising coarse fibrous material and finely particulate material. The liquid portion, a solution of water-soluble protein and other water-soluble plant material, is deproteinized and treated to remove nicotine.

The pigments are removed from the coarse fibrous material and the finely particulate material and separated into green pigments and non-green pigments. The non-green pigments, deproteinized solution and depigmented fibrous material are combined to obtain a tobacco product suitable for use as filler tobacco in cigarettes and other tobacco manufactures.

DETAILED DESCRIPTION OF THE INVENTION

The process of the present invention can be used to obtain a deproteinized tobacco product which is freed of nicotine and green pigment materials from the leaves of tobacco plants of all types. The process is well-suited to the large-scale processing of either flue-cured or burley-type tobaccos, the tobaccos most widely used in cigarette manufacture.

The process of the present invention can utilize the leaves of mature tobacco plants as used in conventional processes. However, it is also suited for the use of the leaves of plants which are short of maturity, i.e., leaves which have not yet begun to yellow naturally. In the latter case, and particularly if the plants are quite immature, the entire plant, i.e., leaves and stalk, are utilized in the invention.

The ability of the process of the present invention to be applied to immature plants has the advantage that only a relatively short growing period is required before the plants are harvested for use in the process. In areas where the growing season is sufficiently long, this will permit more than one crop to be grown in a single growing season.

After detachment of the leaves from the tobacco plant, the leaves, or leaves and stalk together if small plants are the source of the leaves, are ground, crushed, or otherwise reduced to a pulp to release the liquid portion of the leaves from the solids. This liquid portion contains the water-soluble proteins occurring in tobacco. The liquid portion is preferably deproteinized in accordance with the process described in the co-pending application for United States patent of Wildman and Kwanyuen, identified above.

Use of that process permits the isolation of ribulose 1,5-diphosphate carboxylase, known to those in the art as "Fraction I" protein, a commercially valuable product, and Fraction II protein. In that process, after detachment of the leaves from the tobacco plant, the leaves, or leaves and stalk together if small plants are the source of the leaves, are ground, crushed or otherwise reduced to a pulp to release the liquid portion of the leaves from the solids. Preferably, the pulping process is carried out in the presence of a reducing agent. In that regard, the pulping process permits phenol oxidase enzymes present in the leaves to contact the leaf proteins. This results in oxidation of aromatic amino acids such as tyrosine which comprise part of the primary structure of proteins. This oxidation modifies the protein, made visually manifest by their becoming brown, and lowers their solubility in water. The reducing agent, in effect, acts as an antioxidant to suppress this oxidation.

The presently preferred reducing agent for use in the invention is 2-mercaptoethanol because it is volatile and evaporates during the further processing described below, leaving little or no residue in the material isolated. However, other reducing agents may also be used. Among these are agents such as sodium metabisulfite and dithiothreitol.

Separation of the residue of these agents, if any, can be done using conventional techniques. The amount of reducing agent sufficient to control the oxidation can vary depending, for example, on the agent selected. In the case of 2-mercaptoethanol, effective suppression of the undesirable oxidation can be achieved using about 5 milliliters of the liquid agent per kilogram of plant material being processed.

The liquid portion of the plant material contains the plant proteins in dissolved form. Heat treatment of the liquid portion of the pulp containing the ribulose 1,5-diphosphate carboxylase followed by cooling induces this protein to crystallize from the liquid. The mechanism by which the heat treatment induces crystallization is not clear. However, it is believed that the heat treatment modifies the protein in some way that favors crystallization.

The solid matter in the pulp induces green-pigmented coarse, easily separated material and finely particulate green-pigmented material which is difficult to separate from the liquid and which comprises pigment materials, starch material and water-insoluble protein material. However, the heat treatment of this invention, the details of which will be described below, in addition to inducing crystallization of the Fraction I protein also causes partial coagulation of the finely particulate green-pigmented material which facilitates its removal during further processing. For example, this material can be removed by moderate centrifugal force. Therefore, the heat treatment is applied to the liquid portion prior to separation of the liquid portion from the coarse solid material. Heating of the entire pulp, i.e., prior to removal of any solid material, is preferred because better yields to the crystalline ribulose 1,5-diphosphate carboxylase are obtained in this way than if heating is performed after removal of the coarse material but prior to removal of the pigmented material.

The heating step is carried out at a temperature and for a time sufficient to induce crystallization of ribulose 1,5-diphosphate carboxylase, as octagonal crystals, from the liquid portion of the pulp when the liquid is cooled. However, in no instance should the liquid portion be heated in excess of the temperature at which the protein denatures, about 52° C., and precipitates immediately as an insoluble mass.

Although lower temperatures than 52° C. may be used, it is preferred to use a temperature of at least about 48° C., as below that temperature the green-pigmented materials do not coagulate sufficiently to permit their easy removal. Furthermore, below 48° C. the heating time required to induce the crystallization of ribulose 1,5-diphosphate carboxylase may be inconveniently long. Best results are obtained by heating the liquid portion to 50°±1° C. for from about 15 to 20 minutes.

The passage of time between harvesting the leaves, converting them to a pulp and heating the pulp as described above reduces the yield of the crystalline ribulose 1,5-diphosphate carboxylase which can be achieved by the process of the present invention. Therefore, these steps should be delayed for as short a time as possible. To that end, it is preferred to perform these operations at or near the site of cultivation as the leaves are harvested.

Conversion of the leaves to a pulp can be by grinding, crushing or any other suitable process.

The heat treatment can be performed either as a continuous or batch process. In a batch process, the pulp is placed in a vessel whereby heat is transferred to the pulp under conditions where no part of the pulp, or at least the liquid portion thereof, is heated to a temperature at which the protein denatures. As indicated above, preferably the pulp is heated to a temperature of 50°±1° C. for from about 15 minutes to about 20 minutes.

In a continuous process, the pulp is pumped without undue agitation through coils immersed in a liquid heated to a temperature such that, by heat exchange, a specified volume of pulp would be heated to 50°±1° C. for from about 15 minutes to about 20 minutes and then through coils in contact with liquid at a temperature lower than 50° C. to reduce the temperature of the pulp.

After having been heated, the liquid and solid portions of the pulp are separated. Separation is conveniently accomplished by first pressing the pulp to express the liquid portion therefrom. The liquid obtained in this way is a "green juice" containing the green-pigmented material. When heated above about 48° C. to cause its coagulation, this material is simply removed, for example, by filtration or moderate centrifugation, to yield a "brown juice."

To obtain the ribulose 1,5-diphosphate carboxylase, the brown juice is cooled to and stored at a temperature at which crystallization will occur, usually at or below room temperature. Particularly good results have been obtained by cooling the brown juice to about 8° C. for about 24 hours. The crystallized ribulose 1,5-diphosphate is separated from the supernatant liquid by filtration or centrifugation.

The supernatant liquid contains Fraction II proteins and a portion of uncrystallized Fraction I protein. These proteins may be recovered by acidifying the supernatant liquid which causes their precipitation. Best results are obtained by acidification to a pH of about 4.5. Less protein is precipitated if a pH of 4.0 or pH 5.0 is employed.

The foregoing description has stressed the process in which the entire pulp is heated prior to separation of the liquid portion. However, as previously indicated, the heating step can be carried out after the liquid portion containing a suspension of the green-pigmented materials is separated from the pulp. Furthermore, where it is not desired to obtain Fraction I protein separately, the heat treatment described above can be dispensed with and the liquid portion acidified to precipitate the water-soluble proteins without separating the Fraction I and Fraction II proteins.

After deproteinization, the resulting clear brown fluid, now nearly devoid of all protein, but containing all of the other water-soluble natural products that were present in the tobacco plants, is treated with base to adjust the pH to greater than 7.0 and then steam-distilled to remove nicotine. After steam distiallation, the fluid is evaporated to dryness to obtain a brown residue having a consistency about like that of molasses. This residue is retained for further use, as described hereinafter.

The pulp is squeezed to separate the liquid portion, which is treated as described above. The residue remaining, a coarse green material containing about 70 percent water, is suspended in a suitable solvent to extract the green-pigmented material. Methanol or acetone can be used for this purpose. In the case of methanol, a sufficient volume of 100 percent methanol is added so that the methanol will be diluted by the water remaining in the green residue to a concentration of about 90 percent methanol. When acetone is used, it is used in an amount which is diluted to a concentration of 80 percent acetone by the residual water in the green residue. When the green residue is suspended in the selected solvent, extraction of the green color is rapid and complete, leaving a light tan to nearly white, fluffy fibrous material from which the solution of pigmented material is easily separated by squeezing, filtration or other suitable process.

The residual solvent is removed from the fibrous residue by evaporation and produces a dry, pleasantly scented, decolorized residue which is subsequently further treated as described below.

The green sludge obtained by separation from the liquid portion is decolorized in essentially the same manner as the coarse residue material described above. Thus, the green sludge is suspended in either methanol or acetone, or other suitable solvent, to extract the pigmented materials to leave a nearly white, dry product which consists of the water-insoluble proteins and starch in the tobacco leaves.

The pigmented materials obtained from the coarse solids and the green sludge are recovered by separating the decolorized solids from the extracted liquid from which the methanol or acetone is evaporated. This results in a suspension comprising globules of water-insoluble green-pigmented materials suspended in water which contains water-soluble yellow pigmented materials. The latter are recovered by evaporation of the water for subsequent utilization.

Separation of the green-pigmented materials from the coarse green residue or the green sludge can be accomplished separately or by combining the solvent extracts from the decolorization of the two solids.

It is known that the yellow, water-soluble pigmented material isolated in this way from the green pigmented material oxidizes during the curing process carried out on conventional tobacco to obtain materials having a quinoid-type structure. Therefore, in a preferred embodiment of the present invention, this material, or at least a portion thereof, is oxidized to obtain similar products. Preferably, the oxidation is carried out by adding sufficient ammonium hydroxide or other volatile bases which have boiling points similar to or below that of water or by bubbling ammonia gas through the aqueous solution containing the yellow pigmented material to adjust the pH to a value of about 10.5. Air or oxygen is then bubbled through the solution until it turns brown. The brown solution is then heated to drive off ammonia and volatile bases including nicotine. The resulting brown solution is retained for further use in the manner described hereinafter.

The green-pigmented materials obtained by evaporation of the methanol or acetone solvent from the solution of pigment materials are, in a preferred embodiment of the present invention, further treated to separate green-pigmented materials from orange-yellow pigmented materials which are also water-insoluble. To do this, the tar-like material obtained when the solvent is evaporated from the solution of pigmented materials is suspended in 2 N potassium hydroxide containing 20 percent methanol and then heated in a closed vessel or other refluxing device at about 60° C. until the material has dissolved.

When all the material has been dissolved, the solution is cooled to 25° C. and the dissolved material subjected to a liquid-liquid extraction using a non-polar solvent to extract the orange-yellow pigmented materials from the solution. Suitable solvents include non-polar aliphatic solvents such as petroleum ether, pentane, hexane or heptane; chlorinated solvents such as chloroform or dichloromethane; aromatic solvents such as benzene or toluene, and cycloaliphatic solvents such as cyclopentane or cyclohexane.

The non-polar solvent extracts the orange-yellow pigmented materials from the solution and these materials are recovered by evaporation of the non-polar solvent employed. The green pigments are not extracted by the non-polar solvents but remain dissolved in the potassium hydroxide-methanol solution. The orange-yellow pigmented materials are retained for further use as described hereinafter.

As a result of the several steps described above, the tobacco has been separated into components which are substantially free of protein, nicotine and green-pigmented materials. These materials can be recombined to obtain a deproteinized tobacco freed of nicotine and green pigment which can be utilized in cigarettes or other smoking products. This is accomplished by placing the decolorized coarse solid material in a rotating container which is equipped with sprayers and heating devices sufficient to maintain the container at a temperature of from about 70° C. to about 80° C. The container is also provided with means for circulating air throughout.

The orange-yellow water-insoluble pigment materials and the water-soluble yellow pigment materials which have not been oxidized are dissolved in a suitable solvent, for example, ethyl alcohol, and are sprayed over the decolorized residue at a controlled rate of spraying which permits the residue to absorb these materials and to begin to assume the brownish color characteristic of conventional cured tobacco.

Next, the brown solution of water-soluble material obtained from the oxidation of a portion of the yellow-pigmented material is sprayed over the solid material, again at a controlled rate of spraying such that the solid material can absorb the solution, to add additional color enhancement and to restore additional flavorants and odoriferous components.

Finally, the molasses-like brown residue obtained from the liquid portion by removal of the water-soluble proteins is redissolved in water and applied to the residue to add yet additional color, aroma and flavor to the reconstituted tobacco product. The agitation of the reconstituted tobacco product is continued until the moisture content reaches a level of about 15% to about 20%. The product obtained in this way closely resembles in hue and texture the reconstituted tobacco product obtained from conventionally cured tobacco and used as a filler in, for example, cigarette manufacture.

As shown by the table below, the tobacco product obtained from both burley and flue-cured type tobaccos, using the process of the present invention, has a reduced content of nicotine, reducing sugar, and products of petroleum ether extraction, i.e., tar content. T,0170

Furthermore, as those skilled in the art will appreciate, by regulating the proportions of the materials sprayed over the decolorized residue obtained as a product of the process of this invention, differing characteristics can be given the reconstituted tobacco product. For example, the product can be modified to have a low content of terpenoids, sterols, carotenoids and other hydrocarbons. Reconstituted tobacco with a low content of fatty acids and lipids or reconstituted tobacco with a low content of polyphenols and organic acids is possible. It is also possible to reconstitute tobacco in a way that it contains either low amounts or enriched amounts of reducing sugars.

Yet another advantage of the process of the present invention is that the tobacco can be cultivated in a way that is less labor-intensive than conventional cultivation. For example, the tabacco plants need not be grown to maturity and harvested in the conventional way. Instead, the plants can be grown and harvested mechanically before maturity and then processed in accordance with the present invention to obtain a product which is suitable for use as a filler in cigarettes and other tobacco products, with a corresponding reduction in the time and labor required to cultivate tobacco in the conventional way.

Finally, if the process of the present invention involves deproteinization of the tobacco in the manner described by S. G. Wildman and P. Kwanyuen in their copending application, a commercially valuable water-soluble protein can be isolated from the tobacco leaves and, at the same time, a tobacco product obtained which is lower in protein, nicotine and tars.

The present invention has been described in terms of the embodiments which are presently preferred. However, in view of the foregoing description of the invention, those skilled in the art will recognize that the process of the invention may be modified without departing from the scope and spirit of the invention.

Accordingly, the invention is to be limited only by the appended claims.

We claim:

1. A process for treating tobacco leaves to obtain a tobacco product suitable for use in a smoking product from which proteins, nicotine and tar have been removed comprising the steps:

(a) converting the leaves to a pulp comprising a mixture of a coarse solid material portion and a liquid portion, the liquid portion containing water-soluble plant material and a suspension of finely particulate material;

(b) separating the coarse solid material from the liquid portion;

(c) separating the finely particulate material from the liquid portion;

(d) separating water-soluble protein and nicotine from said liquid portion;

(e) separating pigmented material from said coarse solid material and said finely particulate material;

(f) separating green pigmented components of said pigmented material from non-green pigmented components; and (g) recombining the depigmented coarse solid material, the liquid portion from which protein and nicotine have been removed and the non-green pigmented components.

2. A process according to claim 1 wherein the liquid portion is heated to a temperature below that at which protein in said liquid portion denatures for a time sufficient to induce ribulose 1,5-diphosphate carboxylase contained in said liquid portion to crystallize when the liquid portion is cooled followed by cooling the liquid portion to crystallize the ribulose 1,5-diphosphate carboxylase.

3. A process according to claim 2 wherein crystallized ribulose 1,5-diphosphate carboxylase is separated from the liquid portion and acid added to the liquid portion to precipitate residual water-soluble protein.

4. A process according to claims 2 or 3 wherein the liquid portion is heated prior to separation from the coarse solid material.

5. A process according to claim 4 wherein the heating is from about 48°–52° C.

6. A process according to claims 1, 2 or 3 wherein the nicotine is removed from the liquid portion by steam distillation.

7. A process according to claims 1, 2 or 3 wherein the pigmented material is separated from the coarse solid material and the fine particulate material by solvent extraction.

8. A process according to claim 7 wherein the solvent is selected from methanol or acetone.

9. A process according to claim 7 wherein the pigmented material is separated into a water-soluble fraction comprising yellow-pigmented material and a water-insoluble fraction comprising water-insoluble green pigmented material and orange-yellow pigmented material.

10. A process according to claim 9 wherein at least a portion of said water-soluble yellow pigmented material is oxidized as an aqueous solution.

11. A process according to claim 10 wherein the solution is adjusted to a pH of about 10.5 by the addition of ammonium hydroxide and a source of oxygen selected from air or oxygen is bubbled through the solution until it turns brown and the brown solution heated to remove volatile bases and nicotine.

12. A process according to claim 9 wherein the water-insoluble fraction is separated into green-pigmented material and orange-yellow pigmented material.

13. A process according to claim 12 wherein to separate the orange-yellow pigmented material from the green-pigmented material, the water-insoluble fraction is dissolved in 2 N potassium hydroxide containing methanol and the resulting solution extracted with a non-polar solvent to remove orange-yellow pigmented material.

14. A process according to claim 13 wherein the non-palor solvent is selected from aliphatic solvents, chlorinated solvents, aromatic solvents and cyclo-aliphatic solvents.

15. A process according to claim 1 wherein the liquid portion is heated to facilitate separation of the finely particulate material.

16. A process according to claim 15 wherein the liquid portion is heated from about 48°–52° C.

17. A process according to claims 15 or 16 wherein the heating is accomplished prior to separation of the coarse solid material from the liquid portion.

18. A process according to claims 15 or 16 wherein the separation of water-soluble protein from the liquid portion is accomplished by adding acid to the liquid portion to precipitate the water-soluble protein.

19. A process according to claim 18 wherein the nicotine is removed from the liquid portion by steam distillation.

20. A process according to claims 15 or 16 wherein the nicotine is removed from the liquid portion by steam distillation.

21. A process according to claims 15, 16 or 19 wherein the pigmented material is separated from the coarse solid material and the fine particulate material by solvent extraction.

22. A process according to claim 21 wherein the solvent is selected from methanol or acetone.

23. A process according to claim 21 wherein the pigmented material is separated into a water-soluble fraction comprising yellow-pigmented material and a water-insoluble fraction comprising water-insoluble green pigmented material and orange-yellow pigmented material.

24. A process according to claim 23 wherein at least a portion of said water-soluble yellow pigmented material is oxidized as an aqueous solution.

25. A process according to claim 24 wherein the solution is adjusted to a pH of about 10.5 by the addition of ammonium hydroxide and a source of oxygen selected from air or oxygen is bubbled through the solution until it turns brown and the brown solution heated to remove volatile bases and nicotine.

26. A process according to claim 23 wherein the water-insoluble fraction is separated into green-pigmented material and orange-yellow pigmented material.

27. A process according to claim 26 wherein to separate the orange-yellow pigmented material from the green-pigmented material, the water-insoluble fraction is dissolved in 2 N potassium hydroxide containing methanol and the resulting solution extracted with a non-polar solvent to remove orange-yellow pigmented material.

28. A process according to claim 27 wherein the non-polar solvent is selected from aliphatic solvents, chlorinated solvents, aromatic solvents and cyclo-aliphatic solvents.

29. A process for treating tobacco leaves to obtain a tobacco product suitable for use in a smoking product from which proteins, nicotine and tar have been removed comprising the steps:

(a) converting the leaves to a pulp comprising a mixture of a coarse solid material portion and a liquid portion, the liquid portion containing water-soluble plant material and a suspension of finely particulate material;

(b) heating the liquid portion to a temperature below that which denatures protein dissolved in the liquid portion;

(c) separating the coarse solid material from the liquid portion;

(d) separating the finely particulate material from the liquid portion;

(e) adding acid to the liquid portion to precipitate the dissolved protein contained therein;

(f) steam distilling the liquid portion to remove nicotine therefrom;

(g) separating pigmented material from the coarse solid material and the finely particulate material by solvent extraction;

(h) separating said pigmented material into a water-soluble fraction comprising yellow pigmented material and a water-insoluble fraction comprisng green pigmented material and orange-yellow pigmented material;

(i) separating the green-pigmented material and orange-yellow pigmented material; and (j) recombining the depigmented coarse solid material, the liquid portion from which protein and nicotine have been removed and the non-green pigmented components.

30. The product of the process of claims 1, 2, 15 or 29.

* * * * *